US011466673B2

(12) United States Patent
Bartlett et al.

(10) Patent No.: US 11,466,673 B2
(45) Date of Patent: Oct. 11, 2022

(54) CRYOPUMP WITH PERIPHERAL FIRST AND SECOND STAGE ARRAYS

(71) Applicant: Edwards Vacuum LLC, Sanborn, NY (US)

(72) Inventors: Allen J. Bartlett, Uxbridge, MA (US); Gerald M. Szarek, Andover, MA (US); Paul K. Mahoney, Attleboro, MA (US)

(73) Assignee: Edwards Vacuum LLC, Sanborn, NY (US)

( * ) Notice: Subject to any disclaimer, the term of this patent is extended or adjusted under 35 U.S.C. 154(b) by 127 days.

(21) Appl. No.: 16/764,562

(22) PCT Filed: Nov. 16, 2018

(86) PCT No.: PCT/US2018/061566

§ 371 (c)(1),
(2) Date: May 15, 2020

(87) PCT Pub. No.: WO2019/099862

PCT Pub. Date: May 23, 2019

(65) Prior Publication Data

US 2020/0284245 A1 Sep. 10, 2020

Related U.S. Application Data

(60) Provisional application No. 62/588,221, filed on Nov. 17, 2017.

(51) Int. Cl.
*F04B 37/08* (2006.01)
*F25B 9/10* (2006.01)
(Continued)

(52) U.S. Cl.
CPC ..... *F04B 37/08* (2013.01); *F25B 9/10* (2013.01); *F25D 19/006* (2013.01); *F04B 37/02* (2013.01); *F17C 2227/0353* (2013.01)

(58) Field of Classification Search
CPC .. F04B 37/08; F04B 37/02; F25B 9/10; F17C 2227/0353
See application file for complete search history.

(56) References Cited

U.S. PATENT DOCUMENTS 4,311,018 A 1/1982 Welch
4,356,701 A 11/1982 Bartlett et al.
(Continued)

FOREIGN PATENT DOCUMENTS

CN 85200140 U 9/1985
CN 103348137 A 10/2013
(Continued)

OTHER PUBLICATIONS

PCT Written Opinion of the International Search Authority dated Mar. 7, 2019 for corresponding PCT Application No. PCT/US2018/061566.

(Continued)

*Primary Examiner* — Lionel Nouketcha
(74) *Attorney, Agent, or Firm* — Theodore M. Magee; Westman, Champlin & Koehler, P.A.

(57) ABSTRACT

In a cryopump, a primary cryopumping array having adsorbent and cooled by a second refrigerator stage extends along radiation shield sides. That array is shielded by a condensing cryopumping array that extends along the primary cryopumping array. The primary cryopumping array may be a cylinder with adsorbent on an inwardly facing surface, and the condensing cryopumping array may comprise an array of baffles having surfaces facing the frontal opening. A raised surface such as a conical surface at the base of the radiation shield redirects molecules received from the frontal opening toward the primary cryopumping array. The refrigerator cold finger may extend tangentially relative to the radiation shield or connect to the base of the radiation shield.

15 Claims, 7 Drawing Sheets

(51) Int. Cl.
*F04B 37/02* (2006.01)
*F25D 19/00* (2006.01)

(56) References Cited

U.S. PATENT DOCUMENTS

| | | | | | |
|---|---|---|---|---|---|
| 4,494,381 | A | | 1/1985 | Lessard | |
| 4,577,465 | A | | 3/1986 | Olsen | |
| 4,791,791 | A | * | 12/1988 | Flegal | F04B 37/08 417/901 |
| 5,211,022 | A | | 5/1993 | Bartlett | |
| 6,155,059 | A | * | 12/2000 | Matte | F04B 37/08 62/55.5 |
| 7,313,922 | B2 | | 1/2008 | Bartlett et al. | |
| 2006/0064990 | A1 | | 3/2006 | Bartlett | |
| 2009/0165469 | A1 | * | 7/2009 | Matsubara | F04B 37/08 62/55.5 |
| 2012/0260675 | A1 | * | 10/2012 | Fukuda | F04B 37/02 62/55.5 |
| 2013/0205805 | A1 | | 8/2013 | Bartlett et al. | |
| 2015/0107273 | A1 | | 4/2015 | Babu | |

FOREIGN PATENT DOCUMENTS

| | | | |
|---|---|---|---|
| CN | 104457007 | A | 3/2015 |
| CN | 205977597 | U | 2/2017 |
| JP | S60173378 | A | 9/1985 |
| JP | H02271088 | A | 11/1990 |
| JP | 2003075004 | A | 3/2003 |
| TW | I333025 | B | 11/2010 |
| WO | 2019099728 | A1 | 5/2019 |

OTHER PUBLICATIONS

PCT Search Report dated Mar. 7, 2019 for corresponding PCT Application No. PCT/US2018/061566.

PCT Written Opinion of the International Search Authority dated Jan. 31, 2019 for corresponding PCT Application No. PCT/US2018/061367.

PCT Search Report dated Jan. 31, 2019 for corresponding PCT Application No. PCT/US2018/061367.

First Office Action dated May 6, 2021 for corresponding Chinese application Serial No. 201880074344.3, 14 pages.

Taiwanese Office Action dated Mar. 3, 2022 and Search Report dated Mar. 2, 2022 for corresponding Taiwanese application Serial No. 107140807.

Japanese Notice of Reasons for Refusal dated Jul. 8, 2022 for corresponding Japanese application Serial No. 2020-526354, 10 pages.

Japanese Search Report dated Jul. 6, 2022 for corresponding Japanese application Serial No. 2020-526354, 10 pages.

* cited by examiner

CRYOPUMP WITH PERIPHERAL FIRST AND SECOND STAGE ARRAYS

CROSS-REFERENCE TO RELATED APPLICATIONS

This application is a Section 371 National Stage Application of International Application No. PCT/US2018/061566, filed Nov. 16, 2018, and published as WO 2019/099862 A1 on May 23, 2019, the content of which is hereby incorporated by reference in its entirety and which claims priority of U.S. Provisional Application No. 62/588,221, filed on Nov. 17, 2017. The entire teachings of the above application are incorporated herein by reference.

BACKGROUND

Cryopumps currently available, whether cooled by open or closed cryogenic cycles, generally follow the same design concept. A low temperature second stage array, usually operating in the range of 4-25 K, is a primary pumping surface. This surface is surrounded by a high temperature cylinder usually operated in the temperature range of 65-130 K, which provides radiation shielding to the lower temperature array. The radiation shield generally comprises a housing which is closed except at a frontal array positioned between the primary pumping surface and the chamber to be evacuated. This higher temperature, first stage, frontal array serves as a pumping site for high boiling point gases such as water vapor, known as Type I gases.

In operation, high boiling point gases such as water vapor are condensed on the cold frontal array. Lower boiling point gases pass through the frontal array and into the volume within the radiation shield. Type II gases, such as nitrogen, condense on the colder second stage array. Type III gases, such as hydrogen, helium and neon, have appreciable vapor pressures at 4K. To capture Type III gases, inner surfaces of the second stage array may be coated with an adsorbent such as charcoal, zeolite or a molecular sieve. Adsorption is a process whereby gases are physically captured by a material held at cryogenic temperatures and thereby removed from the environment. With the gases thus condensed or adsorbed onto the pumping surfaces, only a vacuum remains in the work chamber.

In systems cooled by closed cycle coolers, the cooler is typically a two stage refrigerator having a cold finger which extends through the radiation shield. The cold end of the second, colder stage of the refrigerator is at the tip of the cold finger. The primary cryopumping array, or cryopanel, is connected to a heat sink at the coldest end of the second stage of the cold finger. This cryopanel may be a simple metal plate, a cup or a cylindrical array of metal baffles arranged around and connected to the second stage heat sink as, for example, in U.S. Pat. Nos. 4,494,381 and 7,313,922, which are incorporated herein by reference. This second stage cryopanel may also support low temperature condensing gas adsorbents such as charcoal or zeolite as previously stated.

The refrigerator cold finger may extend through the base of a cup-like radiation shield and be concentric with the shield. In other systems, the cold finger extends through the side of the radiation shield. Such a configuration at times better fits the space available for placement of the cryopump.

The radiation shield is connected to a heat sink, or heat station, at the coldest end of the cold first stage of the refrigerator. This shield surrounds the colder second stage cryopanel in such a way as to protect it from radiant heat.

The frontal array that closes the radiation shield is cooled by the cold first stage heat sink through the shield or through thermal struts, as disclosed in U.S. Pat. No. 4,356,701, which is incorporated herein by reference.

Cryopumps need to be regenerated from time to time after large amounts of gas have been collected. Regeneration is a process wherein gases previously captured by the cryopump are released. Regeneration is usually accomplished by allowing the cryopump to return to ambient temperature and the gases are then removed from the cryopump by means of a secondary pump. Following this release and removal of gas, the cryopump is turned back on and after re-cooling is again capable of removing large amounts of gas from a work chamber.

The practice of the prior art has been to protect the adsorbent material placed on the second stage cryopanel, e.g. by enclosing the second stage adsorbent with chevrons, to prevent condensing gases from condensing on and hence blocking the adsorbent layer. In this manner, the layer is saved for the adsorption of noncondensing gases such as hydrogen, neon, or helium. This reduces the frequency of regeneration cycles. The chevrons, however, decrease the accessibility of the non-condensables to the adsorbent.

A figure of merit of cryopumps is the capture probability of hydrogen, the probability that a molecule of hydrogen that reaches the open mouth of the cryopump from outside of the pump will be captured on the second stage of the array. The capture probability directly relates to the speed of the pump for hydrogen, the liters per second captured by the pump. Higher rate pumps of conventional design have a capture probability of hydrogen of 20% or greater.

FIG. 1 illustrates a prior art cryopump positioned in a vacuum vessel 102. The vacuum vessel is at ambient temperature and is mounted to a process chamber, typically through a gate valve, by means of a flange 104. Components of the cryopump within the vacuum vessel 102 are cooled by a two-stage cryogenic refrigerator 106. The refrigerator includes a cold finger having a first stage displacer 110 and a second stage displacer 114 that reciprocate within cylinders 112 and 116 of the cold finger. The cold finger is mounted to a drive motor through a flange 118 and extends through a side port 108 of the vacuum vessel 102.

The radiation shield 120 positioned within the vacuum vessel is cooled by the cold first stage 112 of the refrigerator through a first stage heat sink 122 at about 65K. A frontal array 124 is formed of louvers 126 that are supported on and cooled through the radiation shield by struts 128 to about 80K.

The design of the frontal array is a balance of design goals. A more open frontal array allows more gas to flow into the volume within the radiation shield to be captured, resulting in higher capture rate. For example, the open design allows hydrogen to more readily pass into the volume for a higher capture rate of hydrogen, a critical design criteria in many applications. On the other hand, a more open design allows more radiation to pass directly to the second stage array and thus presents an undesirable radiation load on the second stage array. Radiation load of the second stage is the percentage of radiation received at the frontal opening of the array that directly impinges on the second stage array. With a more closed design, radiation is more likely to be blocked by the frontal array or be limited to line of sight paths to the radiation shield 120, decreasing second stage radiation load. However, gases that are intended to be condensed on or adsorbed on the second stage array are more likely to first strike the louvers 126 of the frontal array.

In a high vacuum environment, such gases are then likely to be emitted back toward the process chamber.

The frontal arrays of U.S. Pat. No. 7,313,922 and in FIG. 1 are open for higher capture probability of hydrogen but have a resultant increase in radiation load to the second stage.

The discussion above is merely provided for general background information and is not intended to be used as an aid in determining the scope of the claimed subject matter. The claimed subject matter is not limited to implementations that solve any or all disadvantages noted in the background.

SUMMARY

Improved cryopump shielding with high capture rate and a low radiation loading on the second stage array may be obtained with the disclosed cryopumping array configuration. In a cryopump, a cryogenic refrigerator comprises a cold stage and a colder stage. A radiation shield has sides, a closed end and a frontal opening opposite to the closed end. The radiation shield is thermally coupled to and cooled by the cold stage. The central volume and frontal opening of the radiation shield are substantially free of cryopumping surfaces. A primary cryopumping array is spaced from but close to and extends along the radiation shield sides. It supports adsorbent material and is coupled to and cooled by the colder stage. A condensing cryopumping array extends along the primary cryopumping array. The condensing cryopumping array shields the primary cryopumping array from radiation passing through the frontal opening of the radiation shield.

The primary cryopumping array may be a cylinder having adsorbent on an inwardly facing surface. The condensing cryopumping array may comprise an array of baffles having surfaces facing the frontal opening. The baffles may be in the path of substantially all straight lines from the frontal opening of the radiation shield to the primary cryopumping array.

The radiation shield closed end may comprise a raised surface that redirects molecules from the frontal opening toward the primary cryopumping array. The raised surface may rise to a point along the center axis of the radiation shield and may be conical.

The cryopump may have at least a 20% capture probability of hydrogen. The radiation load to the primary cryopumping array may be less than 3%, preferably less than 2%, and more preferably less than 1%.

The cryogenic refrigerator may comprise a cold finger, having a cold stage and a colder stage, that extends tangentially relative to the radiation shield. The radiation shield may be thermally coupled to and cooled through a shield that is coupled to the cold stage and that surrounds the colder stage of the refrigerator.

Alternatively, the colder stage of the refrigerator may be coupled to a base of the primary cryopumping array and a raised surface that redirects molecules from the frontal opening toward the cryopumping array sides is provided on a floor above the base of the primary cryopumping array. The condensing cryopumping array and floor may be coupled to the cold stage of the refrigerator through struts that pass through the base.

The cryopump may include a mounting flange having a flange opening. The vacuum vessel, the radiation shield and the primary cryopumping array each having an internal diameter greater than the internal diameter of the flange opening.

The Summary is provided to introduce a selection of concepts in a simplified form that are further described in the Detailed Description. This summary is not intended to identify key features or essential features of the claimed subject matter, nor is it intended to be used as an aid in determining the scope of the claimed subject matter.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

DETAILED DESCRIPTION

Figure 1:
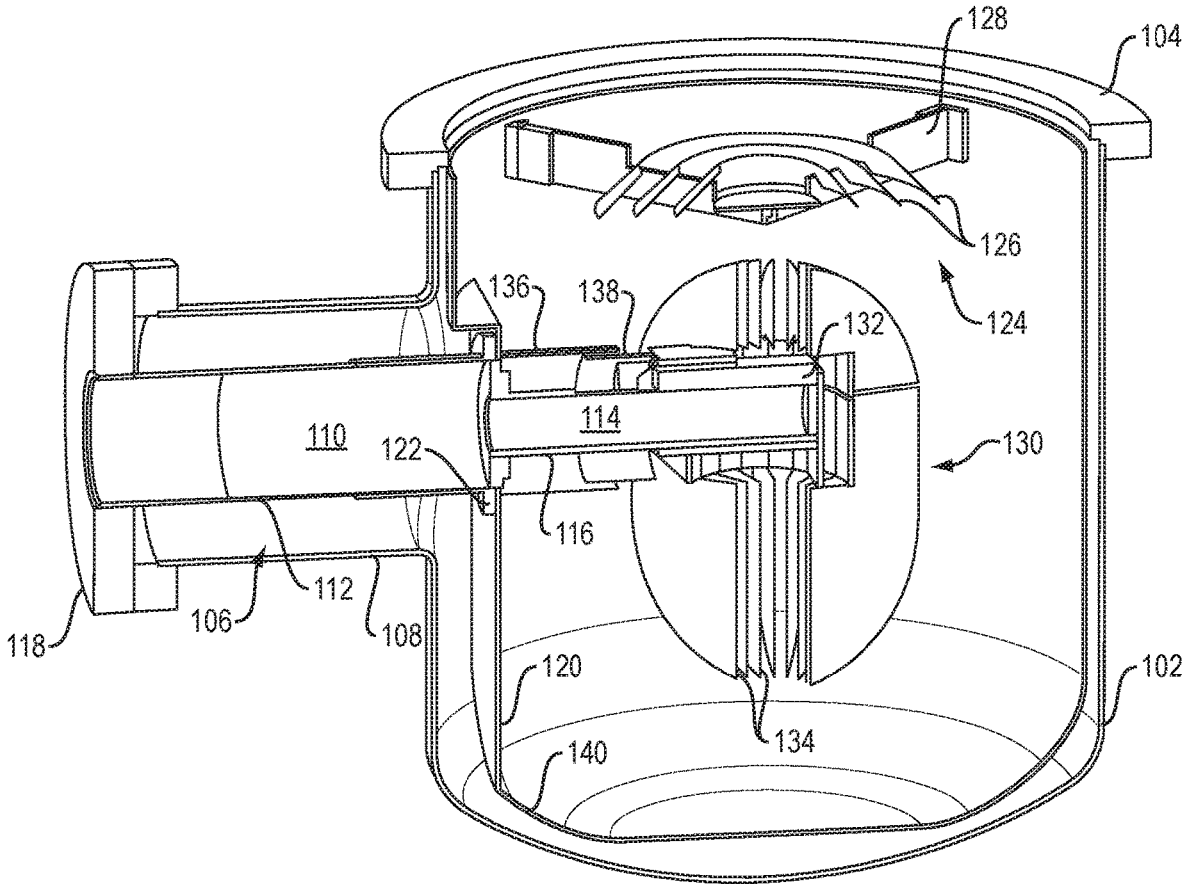
FIG. 1 (PRIOR ART)
FIG. 1 is a cross-sectional perspective view illustrating a prior art cryopump.

A description of example embodiments follows.

In any cryopump design, a trade-off is made between molecular conductance to the second stage array and protection from thermal radiation to the second stage array. As discussed above, with a conventional cryopump design the second stage array is typically centrally located within the surrounding radiation shield. The mouth of the radiation shield contains a planar radiation baffle assembly that is designed to simultaneously block radiation to the second stage array while allowing transmission of molecules to the array. In the conventional design, high pumping speed comes at the penalty of high radiation and contaminant exposure of the second stage array.

The innovation presented here turns a conventional cryopump design approach "inside-out." This is accomplished by moving the second stage array assembly from the central location to the outer periphery of the radiation shield. By moving the array to this location one can significantly increase the molecular conductance to the array by virtue of the increase in surface area of the array. One can also provide increased radiation shielding simultaneously with increased conductance by eliminating the frontal array and instead providing a first stage array at the periphery inside the second stage array.

By changing the location and configuration of the radiation baffles from the conventional planar frontal location to a cylindrical peripheral location, the baffles can be more opaque to radiation while still transmitting a high percentage of incident molecules. In fact, all direct paths of radiation from the frontal opening can be blocked while maintaining high molecular conductance to the second stage array. This is accomplished by significantly increasing the surface area of the radiation baffle assembly. In the current invention the cylindrical radiation baffle assembly can have up to four times the surface area of a conventional planar baffle assembly.

By example, a 320 mm frontal opening diameter cryopump of conventional design can achieve a hydrogen pumping speed of 15,000 l/sec, but at the penalty of having a radiation load to the second stage greater than 10% of the total incident frontal radiation. Radiation load of the second stage is the percentage of radiation received at the frontal opening of the radiation shield that directly impringes on the second stage array. With the "inside-out" design approach, a hydrogen pumping speed of greater than 15,000 l/sec is predicted with a radiation load of less than 5% of the total incident frontal radiation. In fact, the direct radiation load may be reduced to less than 0.1%.

Radiation load is also a close approximation of the percentage of contaminant, such as photoresist from the process chamber, which sticks to the second stage array after being received at the frontal opening of the radiation shield. Such contaminants travel in a straight line in the high vacuum environment and stick to a first contacted surface.

Figure 2:
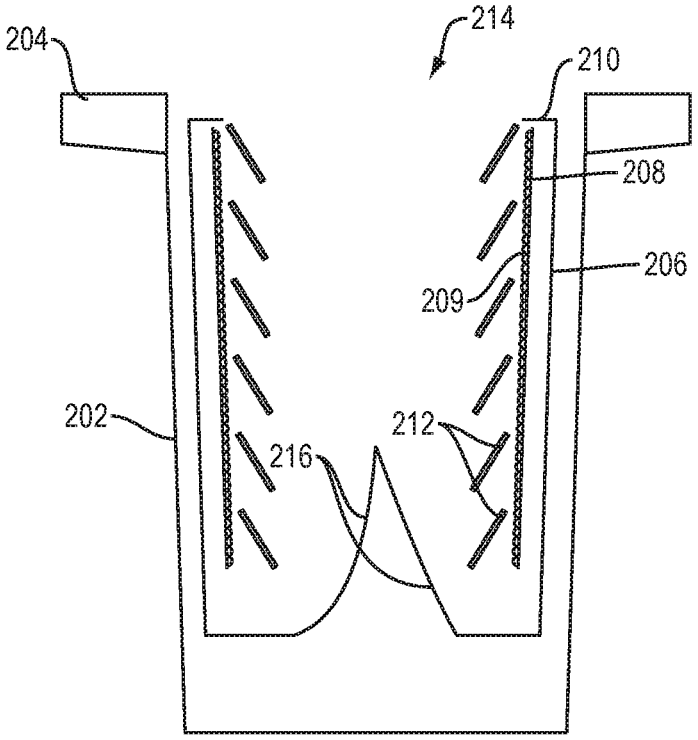
FIG. 2 is a cross-sectional view of a cryopump embodying the present invention.

An embodiment of the invention is shown in FIG. 2. A vacuum vessel 202 is provided with a flange 204 for coupling to a process chamber, typically through a gate valve. A modified cylindrical radiation shield 206 is positioned within the vacuum vessel. Unlike a conventional cryopump, the second stage array is not centered within the radiation shield but is instead reconfigured to extend along the length of the radiation shield. As shown, it may be a simple cylindrical member 208 cooled by the colder second stage of the cryogenic refrigerator. A more complicated array such as of angled baffles may also be used. Adsorbent 209 may coat the entire inner surface of the second stage cylinder 208. The second stage cylinder is 208 is protected from radiation passing through the frontal opening 214 of the radiation shield by a cylindrical condensing cryopumping array of baffles 212 that are angled downwardly to face the frontal opening 214. An inwardly extending rim 210 at the top of the radiation shield similarly blocks radiation to the second stage cryopumping array.

This enhancement significantly increases the surface area of the array and opens up the central core of the pump volume. The open central volume allows for high conductance of molecules into the core of the pump. With the high surface area second stage array 208, a high net capture probability of incident molecules is obtained.

A further enhancement of this innovation is the addition of a molecular focusing element 216 at the bottom of the first stage array. This element is depicted as a raised surface 216 of the closed end of the radiation shield 206. The purpose of this feature is to redirect molecules that impinge on this surface toward the second stage condensing/adsorption array. At high vacuum, molecules do not conform to the rules of direct reflection where the angle of incidence equals angle of departure. Rather, molecules that do not condense at the radiation shield temperature have a finite residence time on the radiation shield once they impinge, and they are then re-emitted off the surface. The direction of re-emittance is favored from the normal to the surface and controlled by the cosine of the angle of emittance. If the radiation shield floor were flat, molecules would preferentially re-emit straight back towards the inlet opening and not be captured. By raising the end surface of the radiation shield, the molecular emission is forced preferentially toward the condensing/adsorbing surfaces. The shape, angle and area of this surface can be modified to maximize the number of molecules captured. Thus, Type I gases are expected to be condensed at the closed end of the radiation shield, but Type II and Type III gases are directed toward the peripheral second stage cryopanel 208 for condensation or adsorption on the second stage.

Alternative shapes of the raised surface are illustrated in FIG. 2. To the right of the center axis of the radiation shield, the raised surface is shown to be conical. To the left of the center axis, the raised surface is shown to be curved to more preferentially direct molecules to the second stage cylinder but at increased complexity and expense of manufacture.

Figure 3:
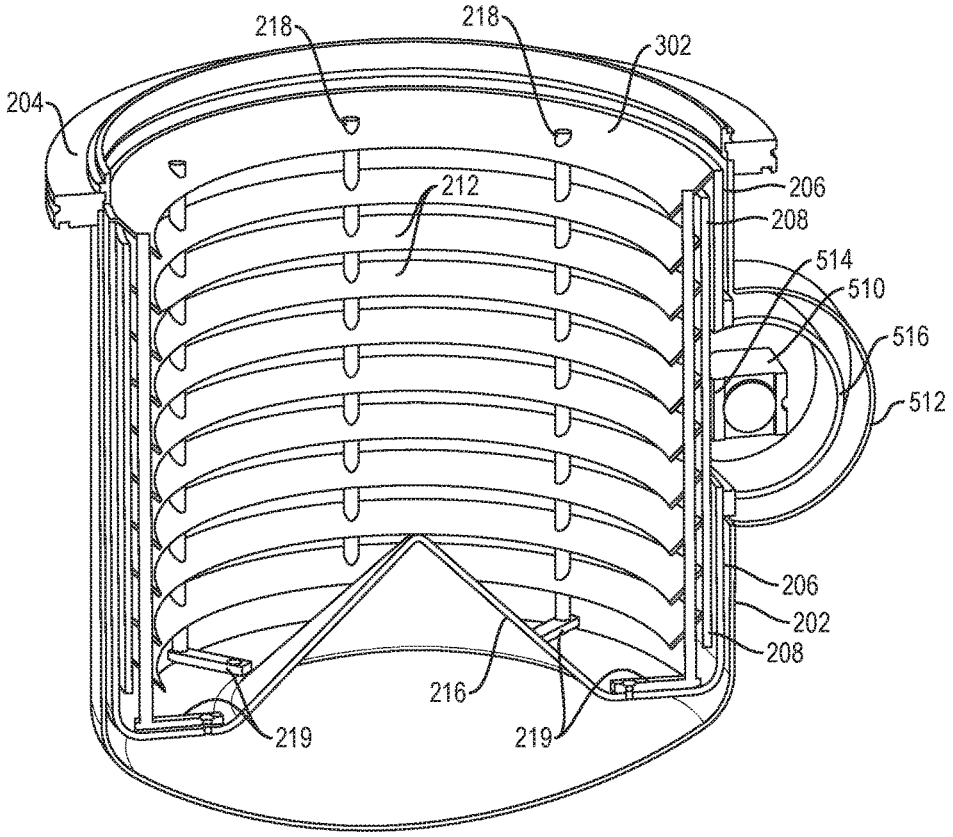
FIG. 3 is a cross-sectional perspective view of an alternative embodiment of the invention.

FIG. 3 is a perspective view of a more explicit embodiment similar to FIG. 2 with the conical raised surface 216. The cryopumping array of baffles 212 are supported by struts 218 that extend from mounts 219 screwed to the closed end of the radiation shield. In this embodiment, the top rim third 302 slopes downwardly directly from the top of the radiation shield 206. It receives the upper ends of the struts 218 to provide structural support to the array of baffles 212 and also to provide thermal coupling to those baffles through the upper end of the radiation shield. Thus, the baffles are cooled from the radiation shield through the struts both from the upper end and the top rim 302 and from the lower end and mounts 219.

The baffles 212 may be sized, angled and spaced relative to each other to completely block all direct radiation from the frontal array, with the baffles being in the paths of all straight lines from the radiation shield frontal opening 214 to the primary cryopumping member 208.

The two stage refrigerator may be conventional. For example, it may provide 65K cooling to the radiation shield and 13K cooling to the second stage array 208 or any temperature within conventional ranges.

Figure 4:
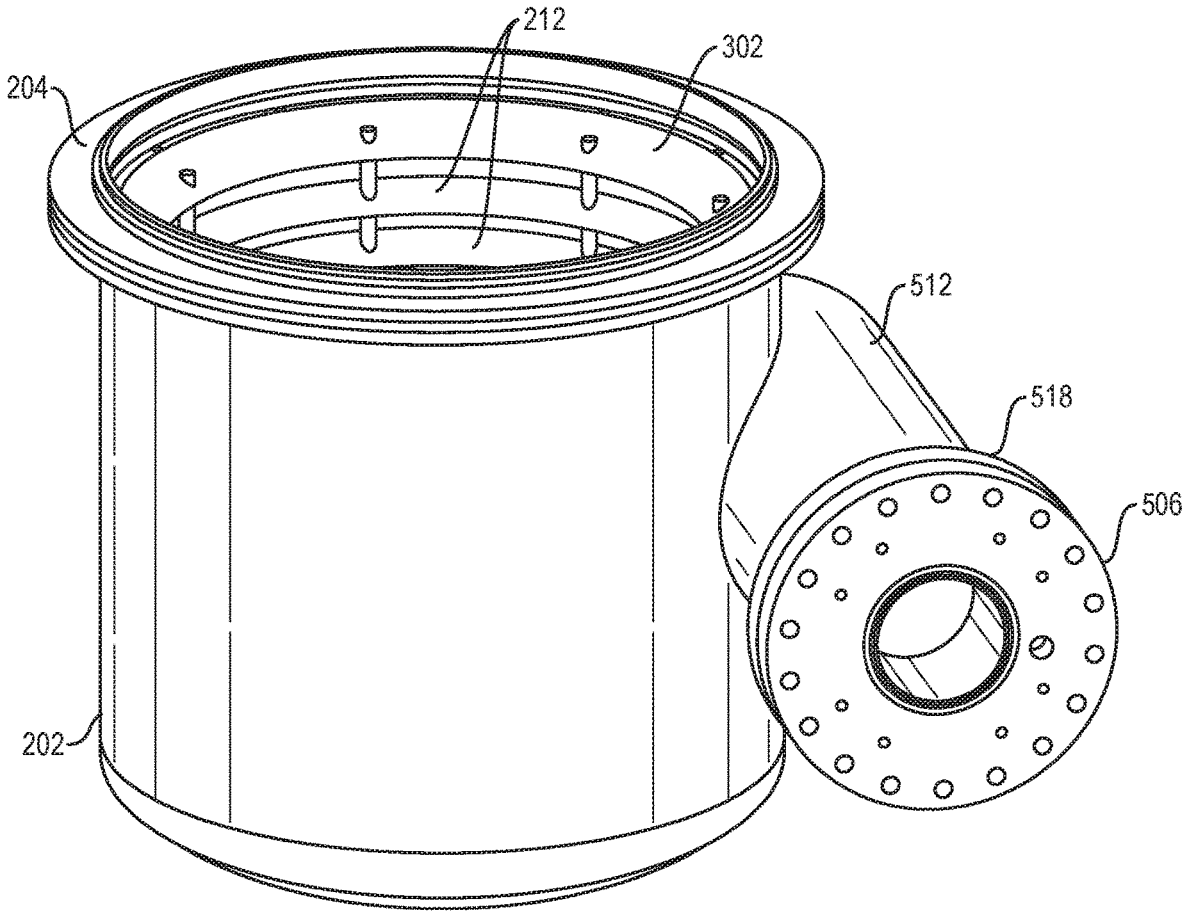
FIG. 4 is a perspective view of the cryopump of FIG. 3.
Figure 5:
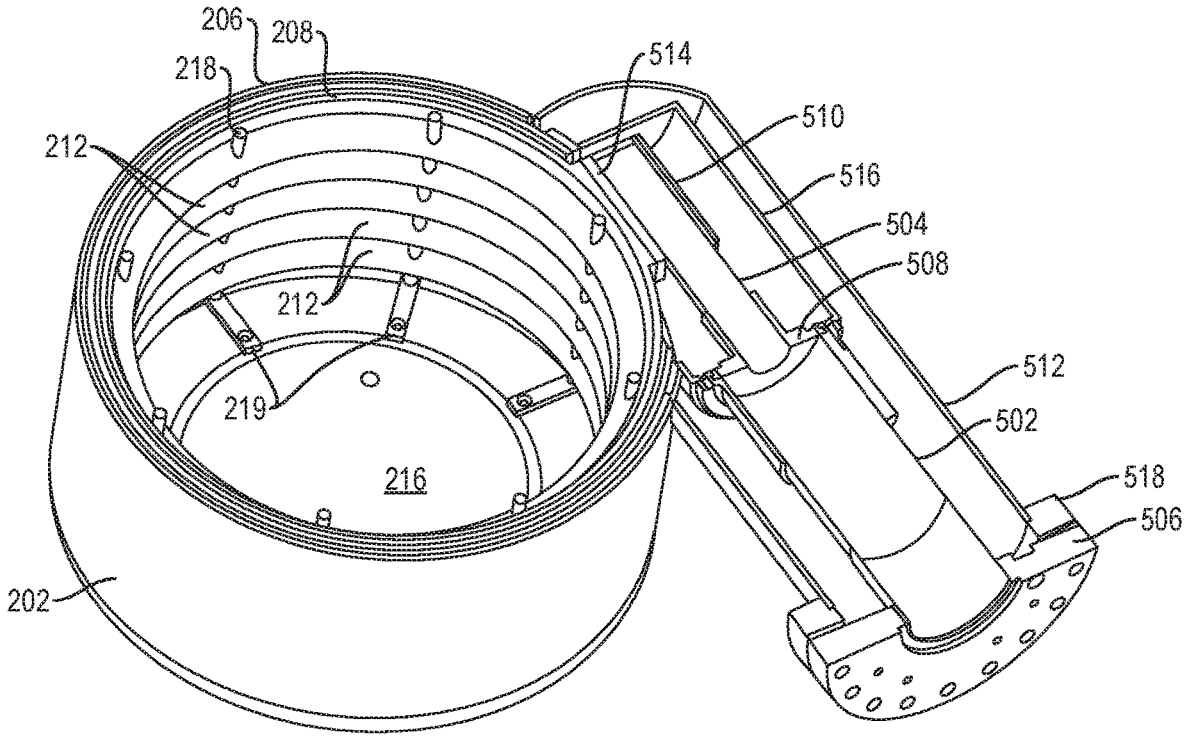
FIG. 5 is a cross-sectional perspective view of the cryopump of FIG. 3 with a horizontal cross-section.

Because the second stage array is positioned close to the radiation shield and to the vacuum vessel, an alternative connection of the refrigerator is provided as illustrated in FIGS. 3, 4 and 5. In this configuration, the two-stage cold finger is mounted tangentially to the vacuum vessel 202 and radiation shield 206. The two-stage cold finger is illustrated in FIG. 5. As in the conventional refrigerator illustrated in FIG. 1, the cold finger includes a first stage cylinder 502 and a second stage cylinder 504 mounted to a drive motor through a flange 506. A two-stage displacer within those cylinders reciprocates to produce the cryogenic cooling. A heat sink 508 at the end of the first stage is cooled to the cold first stage temperature, typically about 65K. A second stage heat sink 510 at the end of the second stage is cooled to a colder temperature, typically about 13K.

Whereas the second stage of the cold finger typically extends radially toward the center of the vacuum vessel to support the second stage array and the first stage extends through a radial cylindrical port, in the present configuration, both stages are contained within a cylindrical port 512 coupled tangentially to the vacuum vessel 202. The port 512 is mounted to the flange 506 and the drive motor assembly through a flange 518.

The cylindrical second stage array is thermally coupled directly to the second stage heat sink 510 through an interface 514. As in conventional designs, the second stage cylinder is enclosed within a cylinder cooled by the first stage. In this case, the cold cylinder 516 that is cooled by the first stage heat sink 508 and that encloses the second stage also serves to provide thermal coupling from the first stage heat sink 508 to the radiation shield 206.

Figure 6:
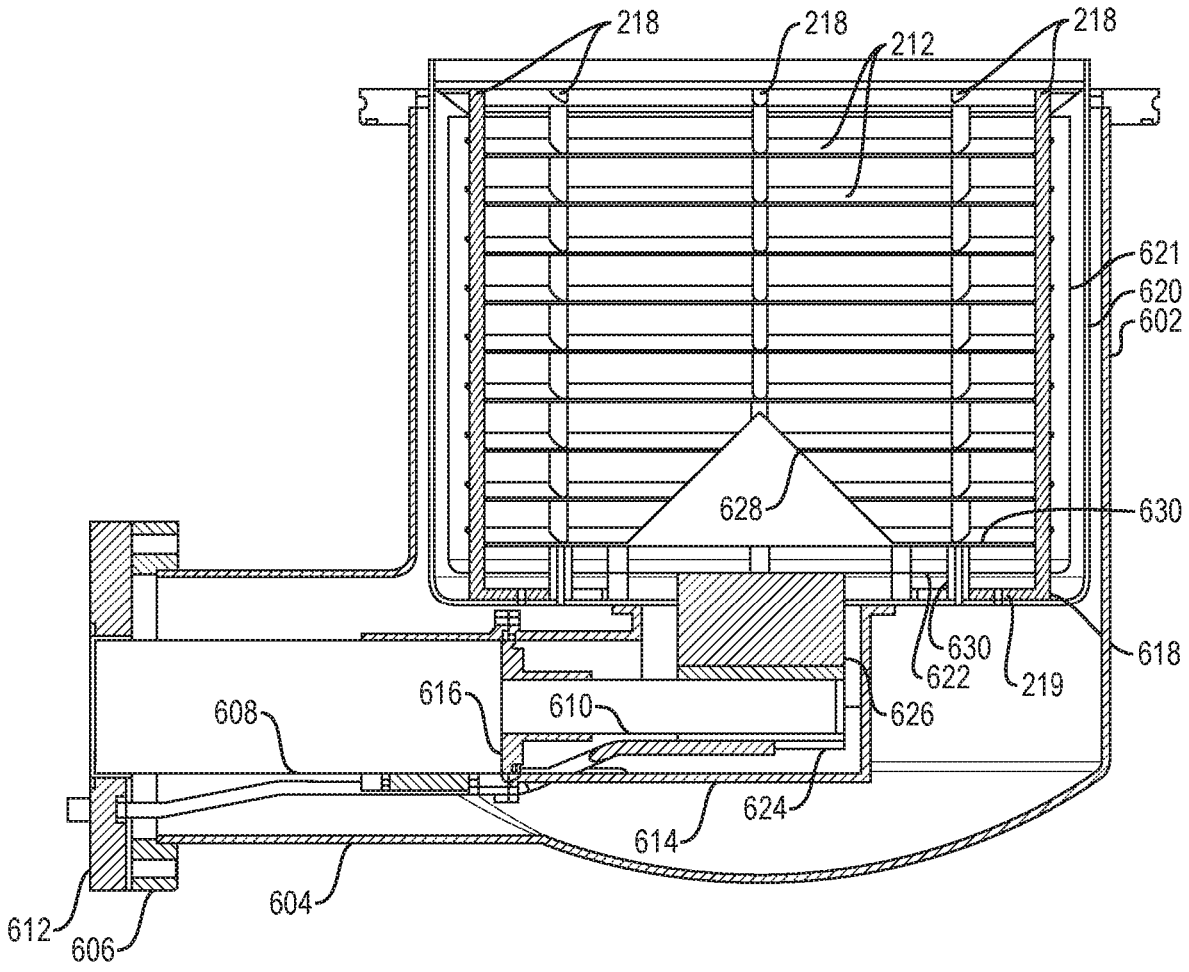
FIG. 6 is an alternative embodiment of the invention in which the two-stage refrigerator is coupled to the cryopumping surfaces from the bottom of the vacuum vessel.

FIG. 6 illustrates an alternative embodiment of the invention in which the refrigerator is coupled to the array set from the bottom of the vacuum vessel rather than tangentially. In this embodiment, the vacuum vessel 602 includes a side port 604 at its base to receive the two-stage refrigerator. The port 604 includes a flange 606 for mounting it to a conventional drive motor. As before, the refrigerator includes first and second stage cylinders 608 and 610 in a cold finger. The cold finger is mounted through flange 612 to the drive motor.

As in the prior embodiment, a cylinder 614 mounted to the first stage heat sink 616 surrounds the second stage and also thermally couples the first stage heat sink to the radiation shield base 618 and cylinder 620.

In this embodiment, the second stage array 621 includes not only a cylinder extending along the cylinder 620 of the radiation shield but also a base 622 that couples to an interface 626 to be cooled by the second stage heat sink 624. Thus, the second stage array is in the form of a cup inside of the cup of the radiation shield. As before, the baffles 212 are supported by struts 218 coupled to the base 618 of the radiation shield. However, in this embodiment the struts extend through openings in the base 622 of the second stage array.

The first stage focusing cone 628 is in this embodiment a raised surface from a floor 630 that is positioned above the base 622 of the second stage array as an extension of the closed end of the radiation shield. The floor 630 is cooled through a set of shorter struts 630 that extend from the base 618 of the radiation shield through openings in the base 622 of the second stage array. Oblong openings may be provided in the base 622 to allow for both a short strut 630 and an extended strut 218 to extend through a single oblong opening.

Figure 7:
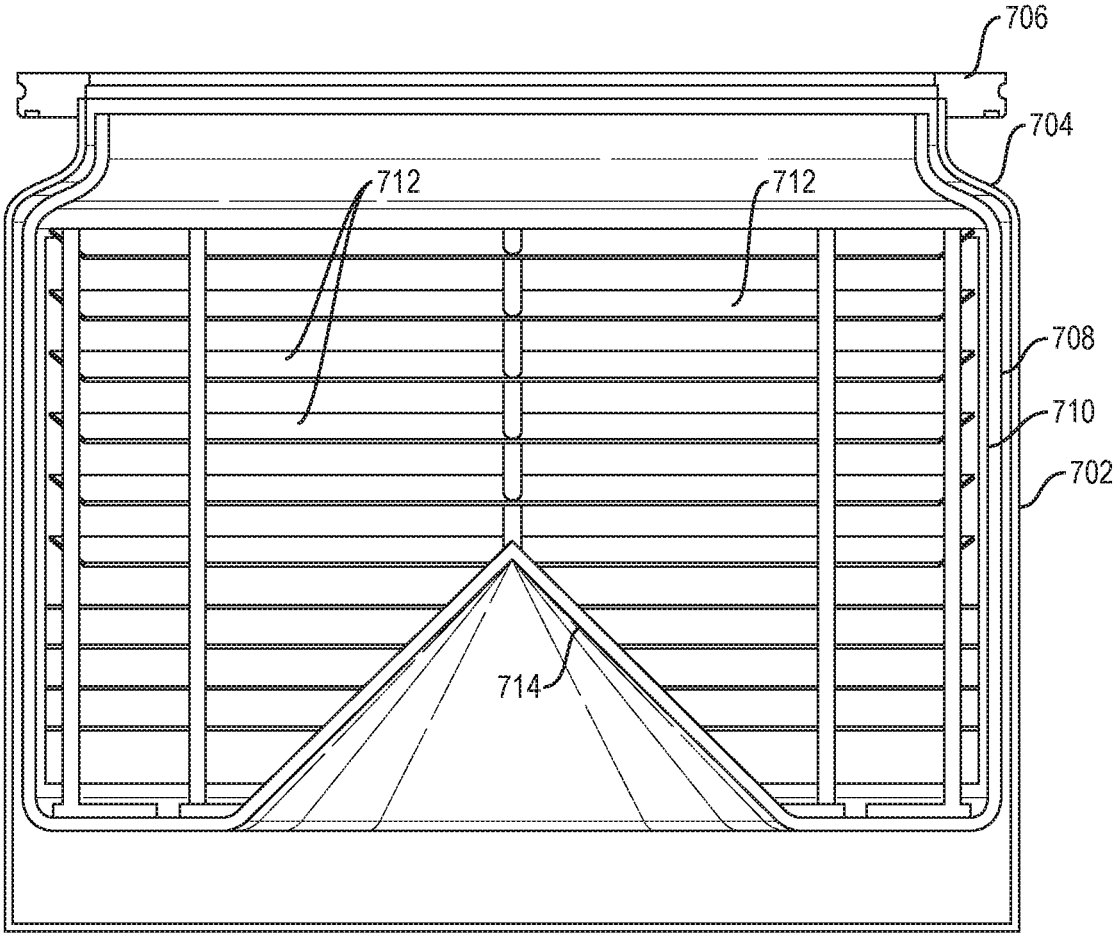
FIG. 7 is an alternative embodiment of the invention in which the vessel, radiation shield, second stage cryopumping array and condensing baffles are expanded radially.

The embodiment of FIG. 7 may be utilized with either the side tangential refrigerator coupling of FIGS. 3-5 or the base coupling of FIG. 6 but is here shown in a configuration consistent with the tangential refrigerator mounted embodiment of FIGS. 3-5. In this embodiment, the vacuum vessel 702 is expanded at 704 below a flange at 706. This allows the cylindrical radiation shield 708 and the cylindrical second stage array 710 to be similarly expanded and for the baffles 712 of the first stage to be expanded. With this expansion, there is an expansion of the diameter of the volume inside the baffle assembly, resulting in increased conductance down the central volume of the pump core. Conductance is a function of area and area increases by the square of the diameter, so incremental increases in diameter significantly increase conductance. As before, a focusing cone 714 is provided at the base of the radiation shield.

The teachings of all patents, published applications and references cited herein are incorporated by reference in their entirety.

While example embodiments have been particularly shown and described, it will be understood by those skilled in the art that various changes in form and details may be made therein without departing from the scope of the embodiments encompassed by the appended claims.

Although the present invention has been described with reference to preferred embodiments, workers skilled in the art will recognize that changes may be made in form and detail without departing from the spirit and scope of the invention.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A cryopump comprising:

a cryogenic refrigerator comprising a cold stage and a colder stage;

a radiation shield having sides, a closed end, a frontal opening free of cryopumping surfaces opposite to the closed end, and a central volume free of cryopumping surfaces, the radiation shield being thermally coupled to and cooled by the cold stage;

a primary cryopumping array spaced from but close to and extending along the radiation shield sides, the primary cryopumping array supporting adsorbent material and being coupled to and cooled by the colder stage;

a condensing cryopumping array extending along the primary cryopumping array between the primary cryopumping array and the central volume so as to surround the central volume.

2. The cryopump as claimed in claim 1 wherein the primary cryopumping array is a cylinder having adsorbent on an inwardly facing surface.

3. The cryopump as claimed in claim 1 wherein the condensing cryopumping array comprises an array of baffles having surfaces facing the frontal opening.

4. The cryopump as claimed in claim 1 wherein the condensing cryopump array is in the path of all straight lines from the frontal opening of the radiation shield to the primary cryopumping array.

5. The cryopump as claimed in claim 1 wherein the radiation shield closed end comprises a raised surface that redirects molecules from the frontal opening toward the primary cryopumping array.

6. The cryopump as claimed in claim 5 wherein the raised surface rises to a point along the center axis of the radiation shield.

7. The cryopump as claimed in claim 5 wherein the raised surface is conical.

8. The cryopump as claimed in claim 1 having at least a 20% capture probability of hydrogen.

9. The cryopump as claimed in claim 1 wherein a radiation load to the primary cryopumping array is less than 3%.

10. The cryopump as claimed in claim 1 wherein a radiation load to the primary cryopumping array is less than 2%.

11. The cryopump as claimed in claim 1 wherein a radiation load to the primary cryopumping array is less than 1%.

12. The cryopump as claimed in claim 1 wherein the cryogenic refrigerator comprises a cold finger, having the cold stage and the colder stage, that extends tangentially relative to the radiation shield.

13. The cryopump as claimed in claim 1 wherein the radiation shield is thermally coupled to and cooled through a shield that is coupled to the cold stage and that surrounds the colder stage of the cryogenic refrigerator.

14. The cryopump as claimed in claim 1 wherein the cryogenic refrigerator comprises a cold finger, the colder stage of the refrigerator is coupled to a base of the primary cryopumping array, a raised surface that redirects molecules from the frontal opening toward the cryopumping array is provided on a floor above the base of the primary cryopumping array, and the condensing array and the floor are coupled to the cold stage of the refrigerator through struts that pass through the base of the primary cryopumping array.

15. The cryopump as claimed in claim 1 further comprising a vacuum vessel having a mounting flange about a flange opening, the vacuum vessel, radiation shield and primary cryopumping array each having a diameter greater than a diameter of the flange opening.

* * * * *